US005503073A

United States Patent [19]

Bär

[11] Patent Number: 5,503,073

[45] Date of Patent: Apr. 2, 1996

[54] DEVICE FOR FASTENING A FORM TO A CYLINDER OF A FINISHING UNIT

[75] Inventor: Wolfgang Bär, Gross-Rohrheim, Germany

[73] Assignee: Heidelberger Druckmaschinen AG, Heidelberg, Germany

[21] Appl. No.: 349,621

[22] Filed: Dec. 5, 1994

[30] Foreign Application Priority Data

Dec. 4, 1993 [DE] Germany ..... 43 41 426.5

[51] Int. Cl.[6] ..... B41F 27/06

[52] U.S. Cl. ..... 101/415.1

[58] Field of Search ..... 101/415.1, 378, 101/409, 410

[56] References Cited

U.S. PATENT DOCUMENTS

| | | | |
|---|---|---|---|
| 3,658,002 | 4/1972 | Preuss | 101/415.1 |
| 4,183,299 | 1/1980 | Cappel | 101/415.1 |
| 4,707,902 | 11/1987 | Kunkel et al. . | |
| 5,182,994 | 2/1993 | Sugiyama et al. | 101/415.1 |
| 5,295,435 | 3/1994 | Fuchi | 101/415.1 |
| 5,398,609 | 3/1995 | Stiel | 101/415.1 |
| 5,415,096 | 5/1995 | Koch et al. | 101/415.1 |

FOREIGN PATENT DOCUMENTS

| | | |
|---|---|---|
| 3000576 | 7/1981 | Germany . |
| 280441 | 6/1990 | Japan . |
| 2104235 | 8/1990 | Japan . |

*Primary Examiner*—Eugene H. Eickholt
*Attorney, Agent, or Firm*—Herbert L. Lerner; Laurence A. Greenberg

[57] ABSTRACT

Device for fastening a respective coating base of given types to a form cylinder of a finishing unit, including a device for clamping a leading edge of a coating base, the leading-edge clamping device being mounted on a support in a form cylinder and extending in the direction of the axis of the form cylinder, a device for clamping a trailing edge of the coating base, and a device for clamping underlays on an outer cylindrical surface of the form cylinder, has at least one pair of clamping bars movable perpendicularly to the axis of the form cylinder, a device including a clamping member for defining an opening for receiving the leading edge of the coating base therein, and a true-to-register fixing device movable respectively in and out of the receiving opening in accordance with the type of the coating base.

13 Claims, 4 Drawing Sheets

DEVICE FOR FASTENING A FORM TO A CYLINDER OF A FINISHING UNIT

BACKGROUND OF THE INVENTION

FIELD OF THE INVENTION

The invention relates to a device for fastening a coating form to a form cylinder of a finishing unit, the fastening device including a leading-edge clamping device formed of a support and a clamping plate attached thereto, a trailing-edge clamping device formed of a round spool or winding coil having a clamping plate attached thereto, and a device for fixing underlay sheets on the outer cylindrical surface of the form cylinder.

Published Japanese patent document JP 2-104235 discloses a cylinder for forming coatings in a coating device. With this prior-art arrangement, varnish cloths or so-called oilcloths may be fixed between a clamping bar and a support within a gap of a coating device. Against the action of compression springs, the :support may have tension applied thereto in a direction towards a cylinder axis. A tensioning or clamping device for underlay sheets or trimmed sheets, which is fixed on the outer cylindrical surface of the form cylinder underneath the coating form, is not actuatable without the use of tools and, before the tensioning or clamping device can be actuated, the coating form has to be removed from the cylinder jacket. A further disadvantage of the state of the prior art is that a true-to-register mounting of a varnish plate, for example, cannot be guaranteed.

A further prior-art arrangement concerning a varnishing roller of a varnishing device has become known heretofore from published. Japanese patent document JP 2-80441. This arrangement is very similar to the prior-art arrangement mentioned hereinbefore.

SUMMARY OF THE INVENTION

It is accordingly an object of the invention to further develop or expand the state of the art by providing for forms permitting partial finishing of individual areas, in addition to forms permitting full-surface finishing, to be fastened true-to-register to the form cylinder of a finishing unit.

With the foregoing and other objects in view, there is provided, in accordance with the invention, a device for fastening a respective coating base of given types to a form cylinder of a finishing unit, including a device for clamping a leading edge of a coating base, the leading-edge clamping device being mounted on a support in a form cylinder and extending in the direction of the axis of the form cylinder, a device for clamping a trailing edge of the coating base, and a device for clamping underlays on an outer cylindrical surface of the form cylinder, comprising at least one pair of clamping bars movable perpendicularly to the axis of the form cylinder, means including a clamping member for defining an opening for receiving the leading edge of the coating base therein, and true-to-register fixing means movable respectively in and out of the receiving opening in accordance with the type of the coating base.

In accordance with another feature of the invention, the clamping bars are disposed above one another, and the true-to-register fixing means are disposed between the clamping bars.

In accordance with a further feature of the invention, the true-to-register fixing means are formed as individually adjustable register stops.

In accordance with an added feature of the invention, the true-to-register fixing means include an adjustable rail and register stops attached to the adjustable rail.

In accordance with an additional feature of the invention, the upper clamping bar is vertically adjustable with respect to the lower clamping bar.

In accordance with yet another feature of the invention, the fastening device includes pre-loading elements disposed between the upper clamping bar and the lower clamping bar.

In accordance with yet a further feature of the invention, the fastening device includes stops for defining an upper adjusting position of the upper clamping bar.

In accordance with yet an added feature of the invention, the clamping member is a clamping eccentric, and the clamping bars include an upper and a lower clamping bar disposed above one another, the receiving opening being limited by the clamping eccentric and the upper clamping bard and individually adjustable register stops being provided in the upper clamping bar.

In accordance with yet an additional feature of the invention, the clamping member is a clamping eccentric, the receiving opening being limited by the clamping eccentric and by the rail which is adjustable in one of the clamping bars, and register stops being attached to the adjustable rail.

In accordance with another feature of the invention, the fastening device includes locking pins insertable into respective recesses for locking the true-to-register fixing means.

In accordance with a further feature of the invention, the underlay clamping device is disposed in the form cylinder below the leading-edge clamping device, and a knurled nut is included for operating the underlay clamping device.

In accordance with an added feature of the invention, the underlay clamping device comprises an underlay clamping rail whereon register bolts are mounted.

In accordance with a concomitant feature of the invention, the register bolts extend into a cylinder wall of the form cylinder.

Advantages of the inventive embodiments are that, in a relatively easy change-over or conversion operation to be effected on the pair of clamping bars, the pressman may now convert from fixing a coating base suitable for full-surface finishing over to fixing a coating base suitable for partial finishing. The opening into which a respective end of a coating base is received may be readily varied in size so that, after having driven the true-to-register fixing means into the opening, a varnishing plate, for example, may be easily and quickly aligned in register, fixed and tensioned. The true-to-register fixing means are effective only in the case of a coating base to be clamped in register. When clamping a coating base suitable for full-surface finishing, such fixing means are not needed and are therefore withdrawn into one of the two clamping bars.

Proceeding from the concept upon which the invention is based, inwardly drivable means for fixing coating bases in register are mounted between the upper and the lower clamping bar. The true-to-register fixing means may be formed either as individually adjustable register stops or as register stops attached to a rail. The individually adjustable register stops are advantageously applied on an upper and a lower clamping bar, the clamping bars being adjustable vertically with respect to one another between two adjusting positions. With this modification, the register stops may be withdrawn from the region of the receiving opening, when changing from full-surface over to partial finishing, before enlarging the width of the opening (for the purpose of receiving a varnishing blanket, for example,) by vertically adjusting the upper clamping bar.

Pre-loading elements are provided between the clamping bars to support the vertical movement. The vertical movement of the upper clamping bar is defined by stops.

In another modification of the inventive subject-matter which is operatable without any tools, a vertical adjustment of the upper clamping bar relative to the lower clamping bar can be dispensed with. In this case, a movable rail is used to which the two register stops are attached. When the rail with the register stops is moved into the receiving opening, the coating bases are aligned in register. When the rail is withdrawn from the opening, the width of the opening is enlarged so that a thicker coating base may be fixed without any problems.

On the one hand, the receiving opening is thus limited by a clamping eccentric and an upper clamping bar between which individually adjustable register stops are provided and, on the other hand, the receiving opening may be limited by a clamping eccentric and the rail to which register stops are attached and which is adjustable in one of the clamping bars.

Locking pins moving in recesses formed on the rail or the register stops are provided to lock the rail with the register stops attached thereto or the individually adjustable register stops in the respective position. The locking pins are actuated by depressing them counter to the direction of preloading applied by a compression spring. After releasing the locking pin, it snaps into either the move-in or move-out position of the rail or into the recesses corresponding to the register stops.

Furthermore, the form cylinder is provided with an underlay clamping device which is disposed below the leading-edge clamping device and operatable by means of a knurled nut. This ensures that an underlay sheet is clamped without any tools, with the operating elements being disposed in the cylinder gap of the form cylinder.

Finally, an underlay clamping bar is mounted on the underlay clamping device, and register bolts attached to the underlay clamping device move into the cylinder wall of the form cylinder. Thus, the trimmed sheets die-cut correspondingly may be fastened to the form cylinder easily and reliably.

Other features which are considered as characteristic for the invention are set forth in the appended claims.

Although the invention is illustrated and described herein as embodied in a device for fastening a form to a cylinder of a finishing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
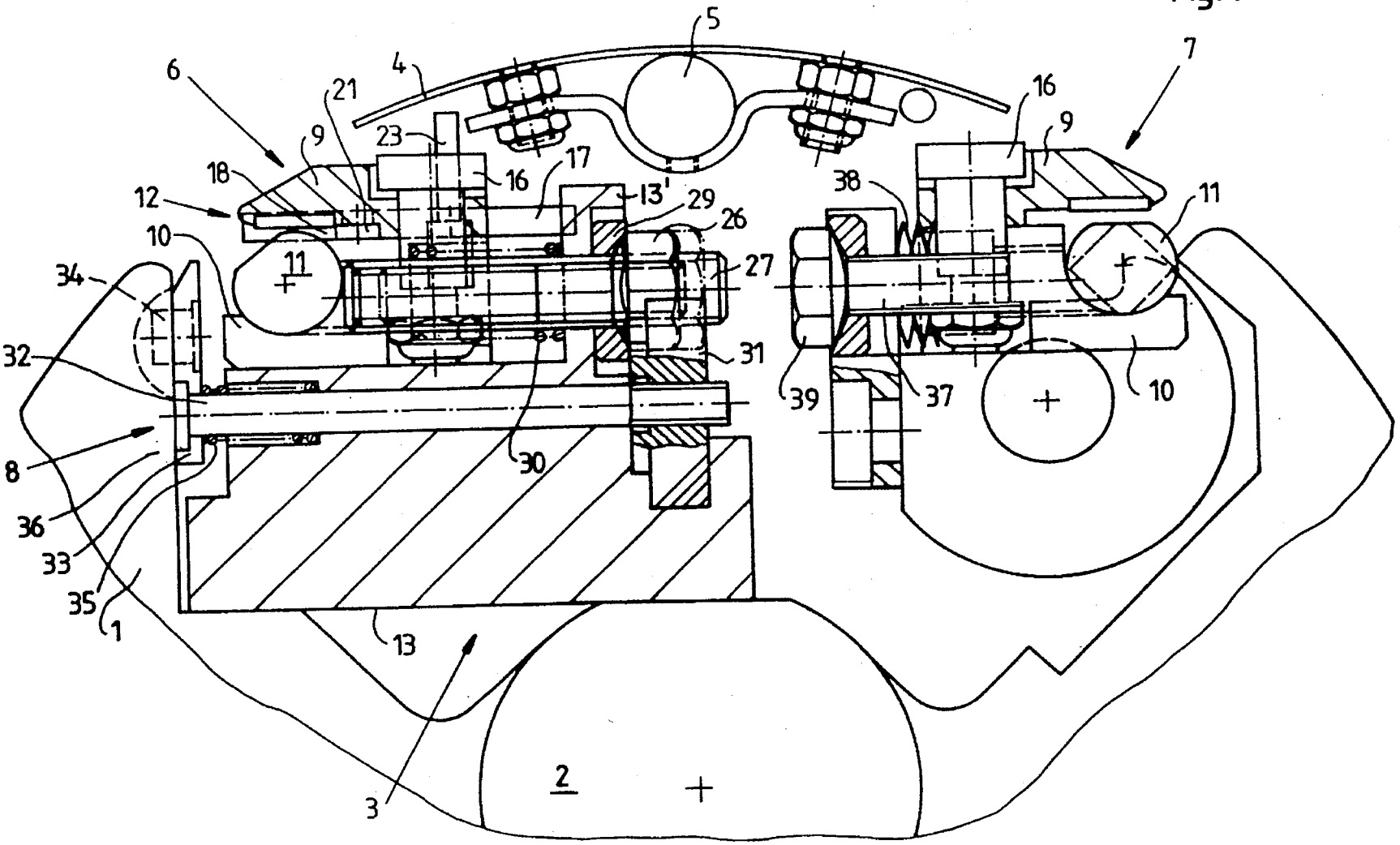
FIG. 1 is a fragmentary side elevational view, partly in section, of a form cylinder and various components of the fastening device according to the invention mounted in a cylinder gap thereof.

Referring now to the drawing and, first, particularly to FIG. 1 thereof, there is shown therein a form cylinder 1 of a finishing unit rotating about a cylinder shaft 2. The form cylinder 1 is formed with a cylinder gap 3 which is covered by a cover 4 disposed in a securing device 5 at a respective front side of the form cylinder 1. At print start, a leading-edge clamping device 6 is located on a support 13 provided in the cylinder gap 3, the support 13 extending in the direction of the cylinder axis and being screwed to the form cylinder 1 above the cylinder shaft 2, as viewed in FIG. 1. A trailing-edge clamping device 7 is located opposite the clamping device 6.

At print start also, a threaded pin 32 of an underlay clamping device 8 extends through the support 13.

Figure 2:
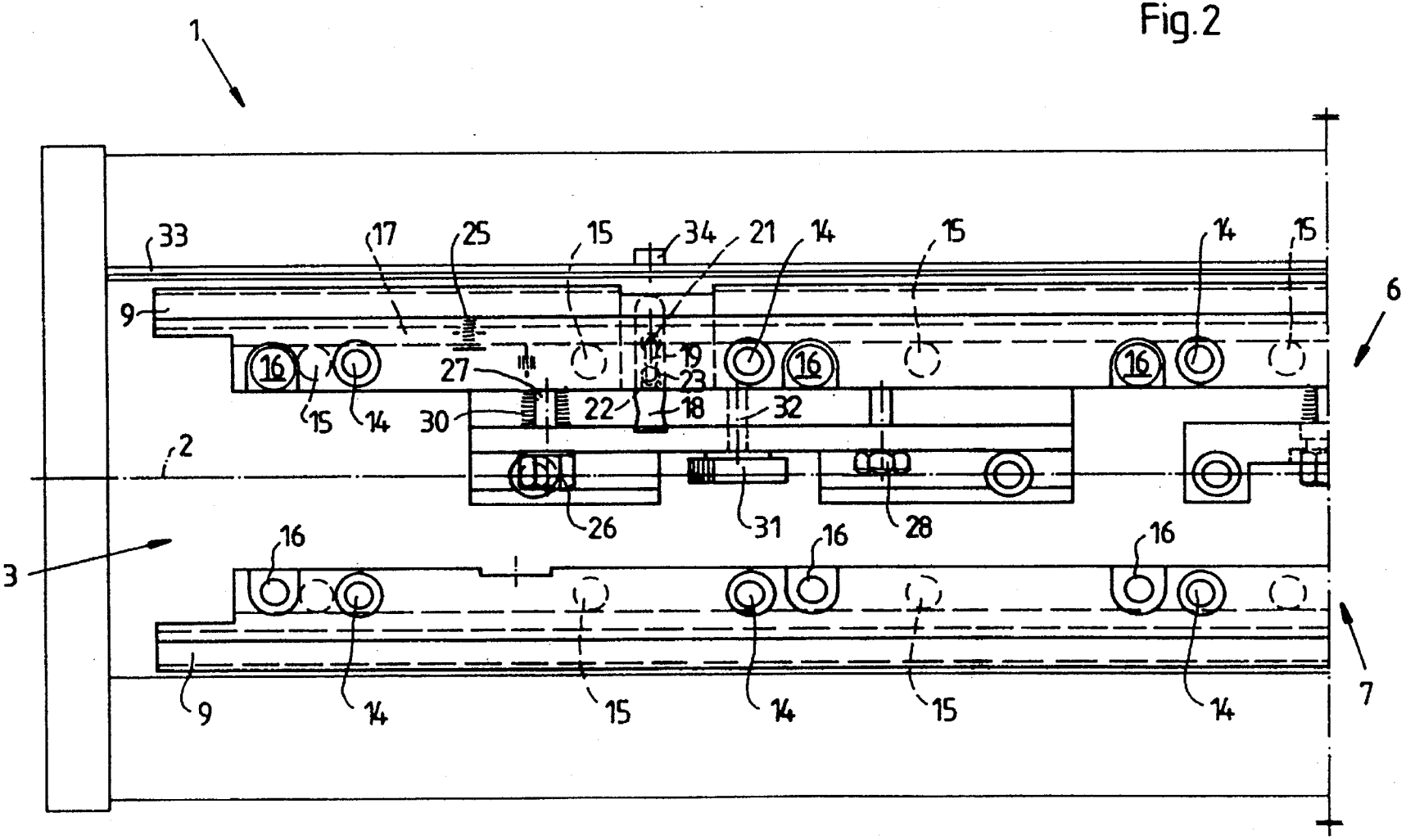
FIG. 2 is a fragmentary top plan view of the cylinder gap of the form cylinder wherein a leading-edge clamping device is mounted.

On the support 13 fixed in the cylinder gap 3, a pair of clamping bars formed of an upper clamping bar 9 and a lower clamping bar 10 are mounted. The clamping bars 9 and 10 are screwed to one another by a screw connection 14 (FIG. 2). In particular, FIG. 2 clearly shows that, between the clamping bars 9 and 10, compression springs pre-loading the clamping bars 9 and 10 are provided. If the two clamping bars 9 and 10 are formed so as to be adjustable perpendicularly to one another, the upper clamping bar 9 is pressed by the compression springs 15 against stops 16, which define the upper adjusting position of the clamping bar 9, after the screw connection 14 has been loosened. In another embodiment of the invention, which is operatable without tools, a register rail 17 to which two register stops 18 are attached may be displaceably mounted on one of the register bars 9, 10 in the vicinity of a take-up or receiving opening 12. The register stops 18 are formed with notches 21 and 22 into which a respective locking pin 23 extends.

Whereas the screw connection 14 has to be loosened when a change-over from partial finishing to full-surface finishing is to be effected in the case of the embodiment with the perpendicularly adjustable clamping bars 9 and 10, the screw connection 14 does does not have to be loosened in the case of the embodiment requiring no tools. After pressing the locking pin 23, the rail 17 is withdrawn, thereby enlarging the opening 12 suitable for receiving a thicker coating base or carrier.

A bolt 27, which is surrounded by a compression spring 30, passes through the clamping bars 9 and 10 which are screwed to one another. The compression spring 30 is braced against a projection 13' of the support 13. The projection 13' is formed with a recess wherein a lug 29 is received against which an adjusting nut 26 is braced. When the leading edge of a coating form, which may be either a varnishing blanket for full-surface finishing or a varnishing plate clamped and aligned in register, is received in the leading-edge clamping device 6, the coating form is displaceable in its entirety transversely to the cylinder axis 2. For this purpose, the pressman turns the adjusting nut 26 in the appropriate direction, and the pair of clamping bars 9 and 10 are moved on the support 13 against the action of the compression spring 30. This permits a re-tensioning or re-tightening of the coating form in circumferential direction of the cylinder, as well as an adjustment of diagonal register at print start.

Moreover, the support 13 is provided with an underlay clamping device 8 which can be operated without any tools. A threaded pin 32 extends through the support 13 and has a knurled nut 31 screwed onto an end thereof which is located near the cylinder axis 2. An underlay clamping bar 33 is fastened to the other end of the threaded pin 32 which faces towards a cylinder wall 36. By means of a compression spring 35, the underlay clamping bar 33 is pressed against the cylinder wall 36. Register bolts 34 onto which die-cut trimmed sheets may be hooked are fastened to the underlay clamping bar 33. By actuating the knurled nut 31, the pressman withdraws the underlay clamping bar 33 against the action of the compression spring 35 until it is possible to insert a trimmed sheet between the cylinder wall 36 and the register bolts 34.

When the knurled nut 31 is turned in the cylinder gap 3 in the opposite direction, the underlay clamping bar 33, supported by the compression spring 35, comes into contact with the hooked-on trimmed sheet and clamps the trimmed sheet in-register against the cylinder wall 36 of the form cylinder. The die-cut or stamped-out regions of the trimmed sheets hooked onto the register bolts 34 ensure a correct clamping position, the clamping also, in this case, being effected without requiring any tools.

At print end, a trailing-edge clamping device 7, which is clampable by a conventional worm drive in the circumferential direction of the form cylinder, is located opposite the leading-edge clamping device 6. At the clamping device 7, there are also provided a pair of clamping bars formed of an upper and a lower clamping bar 9 and 10, respectively, which are connected to one another by a screw connection 14. A diagonal register bolt 37 having an adjusting head 39 which is received in a lug extends through the clamping bars of the clamping device 7. A package of cup springs 38 produces a pre-loading between a stop and the clamping bars 9 and 10, respectively. At print end, the diagonal register on the form cylinder 1 may be influenced or is controllable by the adjusting head 39. Of course, the take-up opening provided at the trailing-edge clamping device 7 may also be modified so as to receive either the other end of a coating base or carrier adapted for full-surface finishing or a coating base or carrier adapted for partial finishing.

FIG. 2 is a plan top view of the cylinder gap formed in the form cylinder and having a leading-edge clamping device disposed therein.

The exemplary embodiment shown in FIG. 2 has two clamping bars 9 and 10, which are adjustable perpendicularly to one another, and two individually adjustable register stops 18. The respective register stops 18 are formed with a slot-type recess 19 limited by two notches or detents 21 and 22, into which a locking pin 23 is driven. In the condition represented in FIG. 2, the locking pin 23 has been driven into the notch 22; the two register stops have also been driven into the opening 12 formed below the upper clamping bar 9 and are thus prepared to receive an appropriate coating base suitable for the partial finishing of a subject or motif. Furthermore, the top plan view of FIG. 2 shows that the upper clamping bar 9, only half of which requires illustration due to the symmetry of both halves thereof, is vertically guided in several stops 16. An engagement or contact force is applied by individual compression springs 15 provided between the clamping bars 9 and 10. This also applies to the trailing-edge clamping device 7 which is only partly illustrated in FIG. 2.

In the top plan view of FIG. 2, the knurled nut 31 which actuates the threaded pin 32 extending below the leading-edge clamping device 6 and moving the underlay clamping bar 33 is clearly recognizable. Reference numeral 28 identifies an adjusting screw by means of which a defined finishing start can be set, an action which is necessary especially for partial finishing. From a scale or dial 25, the retensioning distance and the diagonal adjustment which has been set can be read off. In the interest of clarity, the dial pointers have not been illustrated, nor is the manner of attachment thereof shown. Furthermore, the position of the respective bolts 27 whereon the respective adjusting nuts 26 are threaded is clearly shown in FIG. 2, the bolts 27 being actuatable by the adjusting nuts 26 for effecting the displacement of the clamping bars 9 and 10 in the circumferential direction of the form cylinder 1.

Figure 3:
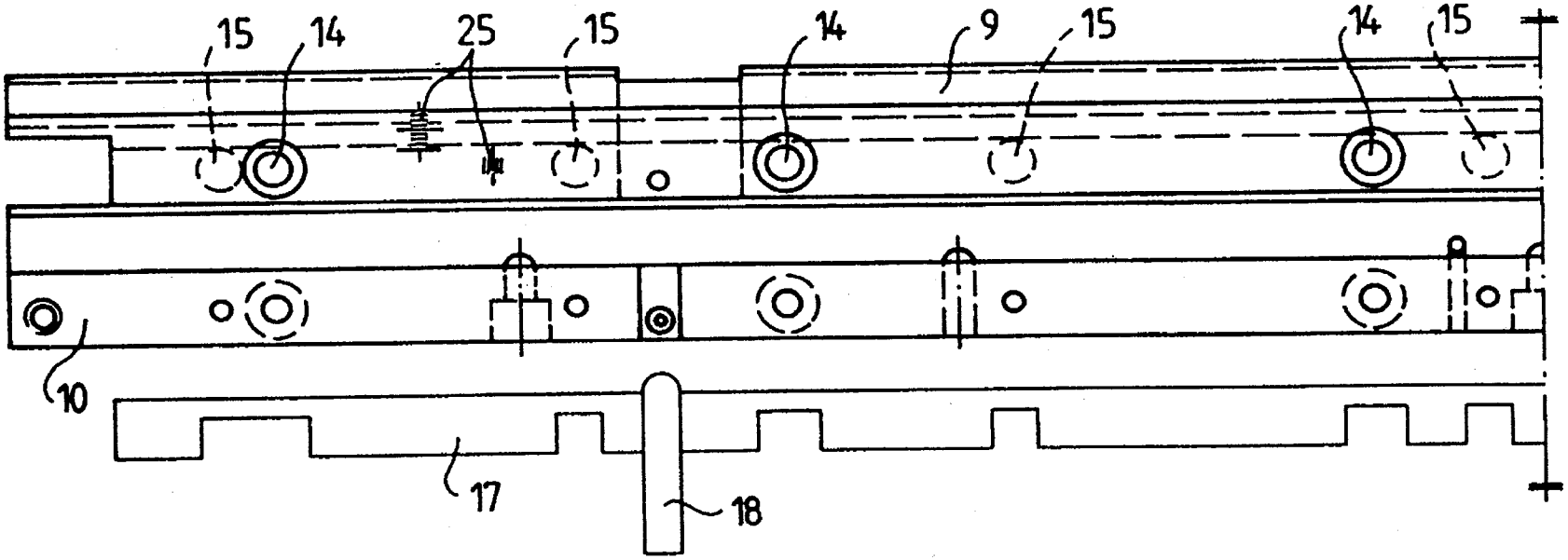
FIG. 3 is another view of a register rail shown in FIG. 2, with register stops fastened thereto.

FIG. 3 is an enlarged view of a change-over or conversion embodiment which is actuatable without any tools and which includes a register rail to which register stops 18 are attached. Because, according to this embodiment, the clamping bars 9 and 10 do not have to be adjusted perpendicularly or vertically to one another, the register stops 16 of the embodiment of FIG. 2 are dispensed with. The register rail is mounted between the partly overlapping clamping rails 9 and 10 and ensures the withdrawal of the register stops 18 from the region of the take-up openings 12, after the locking pin 23 has unlocked the register rail 17. Because of the symmetry of the construction, FIG. 3 also shows only half of the register rail 17 and the clamping bars 9 and 10.

Figure 4:
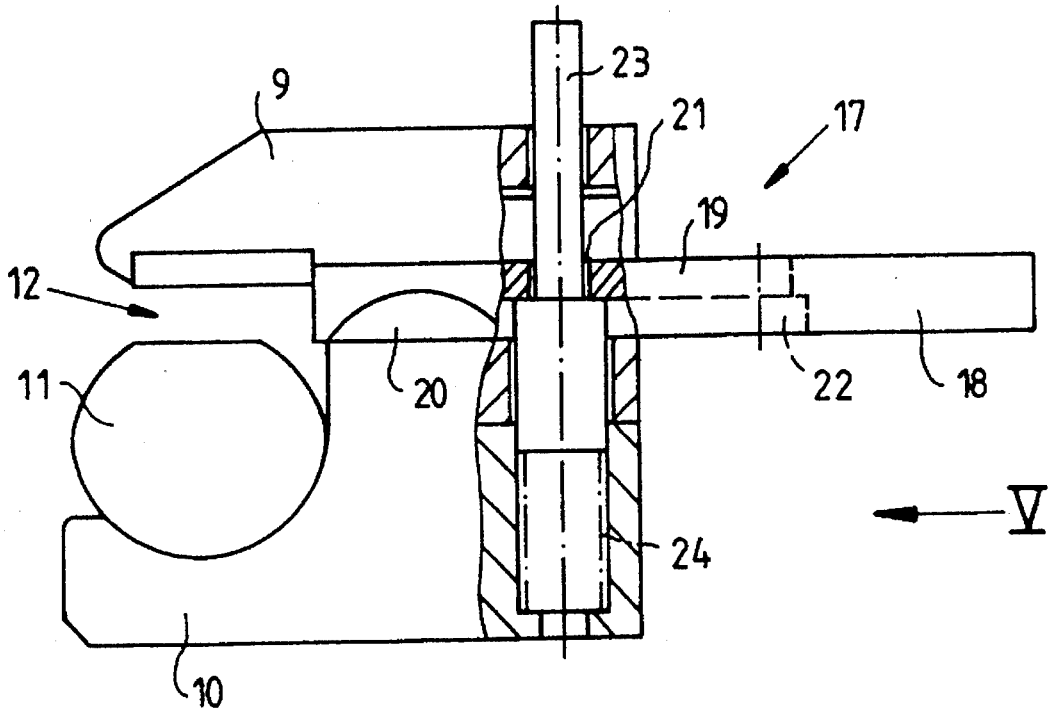
FIG. 4 is an enlarged fragmentary view of FIG. 1 showing a locking device for true-to-register fixing means forming part of the fastening device according to the invention.
Figure 5:
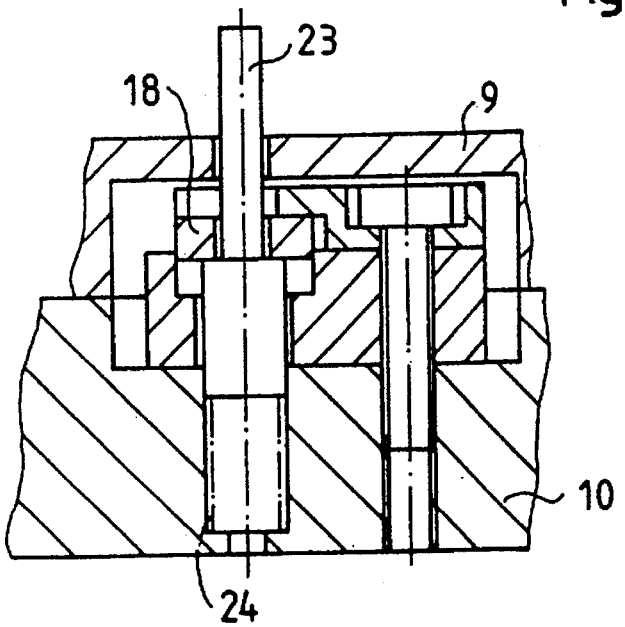
FIG. 5 is a fragmentary view of FIG. 4 as seen in the direction of the arrow V showing a component of the fastening device which has an individually adjustable register stop.

FIG. 4 is an enlarged view of the locking mechanism of a true-to-register fixing device according to the embodiment which has two individual register stops and perpendicularly or vertically adjustable clamping bars.

In the condition or phase represented in FIG. 4, the register stops 18 are located outside the opening 12. In this position, the register stops are held by the locking pin 23. Due to the action of a compression spring 24, the locking pin 23 passes into a notch or detent 21 of the recess 19. When the pressman actuates the locking pin 23, the notch 21 of the recess is released. The register stops 18 may be inserted into the take-up opening 12 and, in this position, may be locked in the notch 22. The register stop 18 must be formed with a bulge 20 corresponding to the contour of the clamping eccentric 11. By turning the clamping eccentric 11, the coating base is finally fixed, it being noted that the means for turning the eccentric do not constitute any of the subject matter of the invention of the instant application.

The perpendicular or vertical adjustability of the upper and lower clamping bars 9 and 10 with respect to one another is achieved by a screw connection 14. With this screw connection, the size of the opening 12 may be converted from that required for fixing a coating base suitable for partial finishing to that for fixing a coating base for full-surface finishing. Only when fixing a coating base suitable for finishing partial areas of the print, are the register stops 18 to be moved into the opening 12. When a varnishing blanket, for example, is being clamped, the register stops 18 remain in their withdrawn position out of the opening 12 and locked by the locking pin 23 in the notch 21. When a thinner coating base suitable for partial coating purposes is subsequently clamped, the size of the opening 12 is modified accordingly by actuating the screw connection 14, prior to inserting the register stops 18.

With the embodiment actuatable without any tools, only the register rail 17 is released from the locked condition thereof by depressing the locking pins 23, the register rail 17 being then inserted into the opening 12 where it is locked. The take-up opening 12 then has a size adapted to a respective coating base suitable for partial finishing. The coating base is aligned with respect to the register stops 18 of the rail 17 before being clamped by an adjustment of the clamping eccentric 12.

I claim:

1. Device for fastening a respective coating base of given types to a form cylinder of a finishing unit, including a device for clamping a leading edge of a coating base, the leading-edge clamping device being mounted on a support in a form cylinder and extending in the direction of the axis of the form cylinder, a device for clamping a trailing edge of the coating base, and a device for clamping underlays on an outer cylindrical surface of the form cylinder, comprising at least one pair of clamping bars movable perpendicularly to the axis of the form cylinder, means including a clamping member for defining an opening for receiving the leading edge of the coating base therein, and true-to-register fixing means movable respectively in and out of said receiving opening in accordance with the type of the coating base.

2. Device according to claim 1, wherein said clamping bars are disposed above one another, and said true-to-register fixing means are disposed between said clamping bars.

3. Device according to claim 1, wherein said true-to-register fixing means are formed as individually adjustable register stops.

4. Device according to claim 1, wherein said true-to-register fixing means include an adjustable rail and register stops attached to said adjustable rail.

5. Device according to claim 2, wherein the upper clamping bar is vertically adjustable with respect to the lower clamping bar.

6. Device according to claim 2, including pre-loading elements disposed between the upper clamping bar and the lower clamping bar.

7. Device according to claim 5, including stops for defining an upper adjusting position of the upper clamping bar.

8. Device according to claim 3, wherein said clamping member is a clamping eccentric, and said clamping bars include an upper and a lower clamping bar disposed above one another, said receiving opening being limited by said clamping eccentric and said upper clamping bar, and including individually adjustable register stops provided in said upper clamping bar.

9. Device according to claim 4, wherein said clamping member is a clamping eccentric, said receiving opening being limited by said clamping eccentric and by said rail which is adjustable in one of said clamping bars, and including register stops attached to said adjustable rail.

10. Device according to claim 1, including locking pins insertable into respective recesses for locking said true-to-register fixing means.

11. Device according to claim 1, wherein the underlay clamping device is disposed in the form cylinder below said leading-edge clamping device, and including a knurled nut for operating the underlay clamping device.

12. Device according to claim 11, wherein the underlay clamping device comprises an underlay clamping rail whereon register bolts are mounted.

13. Device according to claim 12, wherein said register bolts extend into a cylinder wall of the form cylinder.

* * * * *